US006470690B1

(12) United States Patent
Sicherman

(10) Patent No.: US 6,470,690 B1
(45) Date of Patent: Oct. 29, 2002

(54) METHOD AND APPARATUS FOR SUPPLYING VAPORIZED GAS ON CONSUMER DEMAND

(75) Inventor: Gadi Sicherman, Hamovil (IL)

(73) Assignee: Exta Exclusive Thermodynamic Applications Ltd., Jerusalem (IL)

( * ) Notice: Subject to any disclaimer, the term of this patent is extended or adjusted under 35 U.S.C. 154(b) by 0 days.

(21) Appl. No.: 09/674,700

(22) PCT Filed: May 12, 1999

(86) PCT No.: PCT/IL99/00254

§ 371 (c)(1),
(2), (4) Date: Nov. 6, 2000

(87) PCT Pub. No.: WO99/58896

PCT Pub. Date: Nov. 18, 1999

(30) Foreign Application Priority Data

May 13, 1998 (IL) ..... 124462

(51) Int. Cl.[7] ..... F17C 7/04; F17C 13/02
(52) U.S. Cl. ..... 62/48.1; 62/49.1
(58) Field of Search ..... 62/50.2, 48.1, 62/48.2, 49.1

(56) References Cited

U.S. PATENT DOCUMENTS 3,827,246 A * 8/1974 Moen et al. ..... 62/50.2
5,373,701 A * 12/1994 Siefering et al. ..... 62/48.1
5,467,603 A * 11/1995 Lehman et al. ..... 62/50.2
5,579,646 A * 12/1996 Lee ..... 62/50.2
5,878,581 A * 3/1999 DeFrances et al. ..... 62/50.2

* cited by examiner

*Primary Examiner*—William C. Doerrler
(74) *Attorney, Agent, or Firm*—Mark M. Friedman

(57) ABSTRACT

A method of supplying vaporized gas from a storage tank storing the gas in liquified form in a lower liquid region and having a vapor region thereover, the method including employing an external source of heat to heat a heat exchange liquid to no more than about 35° C., bringing the heat exchange liquid into heat exchange relation with at least a portion of the liquified gas so as to transfer heat from the external source of heat to the liquified gas, and supplying vaporized gas to the consumer, according to the consumer demand, directly from the vapor region of the storage tank. The heat exchange relation is controlled such that the at least portion of the liquified gas which is heated remains mostly in a liquified state but that the temperature of the liquified gas is prevented from falling below a predefined minimum operational temperature.

27 Claims, 6 Drawing Sheets

METHOD AND APPARATUS FOR SUPPLYING VAPORIZED GAS ON CONSUMER DEMAND

FIELD AND BACKGROUND OF THE INVENTION

The present invention relates to methods and apparatus for supplying to consumers vaporized gas from a storage tank such as an above-ground or below-ground tank, cylinder, or the like, storing the gas in liquified form.

Many techniques are known in liquified-gas storage and distribution systems for supplying the "heat of vaporization" necessary for converting a liquified gas to a vapor. One technique supplies the heat of vaporization by convection with respect to the ambient heat, but such a technique requires large heat-convection surfaces according to the demand for the vaporized gas. Another technique provides an external vaporizer for heating the liquified gas and converting it to vapor form as the gas is outputted from the storage tank or recirculated back to the vapor, but such techniques involve large installations, and therefore large installation and maintenance expenses in preparing and maintaining the infrastructure. These techniques also require vapor/liquid separation devices which introduce reliability and safety problems.

OBJECTS AND BRIEF SUMMARY OF THE PRESENT INVENTION

An object of the present invention is to provide a novel method, and also a novel apparatus, for supplying vaporized gas from a liquified-gas storage tank.

According to one aspect of the present invention, there is provided a method of supplying vaporized gas from a storage tank storing the gas in liquified form in a lower liquid region and having a vapor region thereover, the method comprising: providing a source of external heat; adding directly to the liquified gas in the storage tank only sufficient heat from the source of external heat to cause the heated liquified gas to remain mostly in the liquified state but to enable the internal heat of the liquified gas within the storage tank, together with the influx of ambient heat, to supply the heat of vaporization for vaporizing, within the storage tank, the liquified gas according to the the consumer demand therefor; and supplying vaporized gas to the consumer, according to the consumer demand, directly from the vapor region of the storage tank.

According to further features in the preferred embodiments described below, the external heat supplied by the source of external heat is controlled by a microprocessor according to the temperature and pressure of the liquified gas within the storage tank, and the liquid/vapor phase diagram of the respective gas.

According to further features in one preferred embodiment described below, the source of external heat includes a heat exchanger having a first fluid circuit through which a heating fluid is circulated, and a second fluid circuit through which a portion of the liquified gas from the liquid region of the storage tank is circulated, heated by the heating fluid, and returned to the storage tank. The heating fluid, heating the portion of the liquified gas circulated through the heat exchanger, vaporizes less than 50%, preferably 0–20%, of the so-heated liquified gas which is returned to the storage tank.

According to another aspect of the present invention, there is provided apparatus for supplying vaporized gas on consumer demand, comprising: a storage tank storing the gas in liquified form in a lower liquid region thereof and having a vapor region thereover; a source of external heat in heat-exchange relation to the liquified gas in the storage tank for supplying heat thereto; a control system for controlling the source of external heat to cause it to add- directly to the liquified gas in the storage tank only sufficient heat to cause the heated liquified gas to remain mostly in the liquified state but to enable the internal heat of the liquified gas within the storage tank, together with the influx of ambient heat, to supply the heat of vaporization for vaporizing within the storage tank the liquified gas according to the consumer demand therefor; and a supply line communicating with the vapor region of the storage tank for supplying vaporized gas to the consumer according to the consumer demand.

The method and apparatus of the present invention thus eliminate the need to deal with vapor, and thereby avoid the need for expensive vapor/liquid units and separators since the liquid/vapor separation is performed within the storage tank itself. Moreover, the method and apparatus minimize the external heat needed for supplying the gas in vapor form, and thereby reduce the heating expenses and the pollution caused be providing the additional heat. The invention may therefore be used for supplying vaporized gas to a consumer in an efficient and reliable manner, and by using equipment which is relatively compact and inexpensive to install and to maintain.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
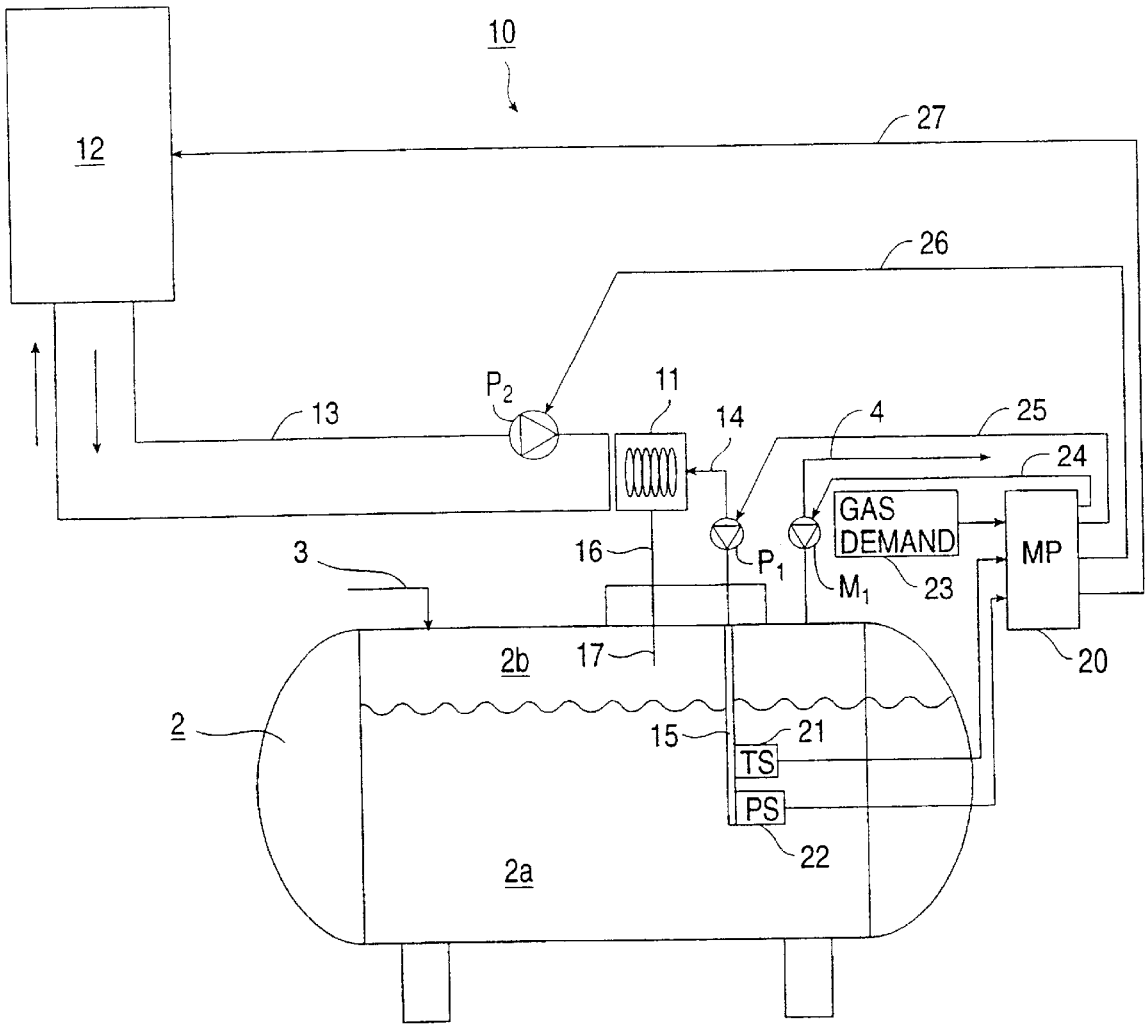
FIG. 1 illustrates one form of apparatus constructed in accordance with the present invention.

FIGS. 1 illustrates a storage tank 2 for storing a gas, such as propane or butane, in liquified form. Thus, the lower region 2*a* of the storage tank 2 contains the gas in liquified form, whereas the upper region 2*b* contains the gas in vapor form. Storage tank 2 is filled via a filling port 3, and supplies the vaporized gas to the consumer via a supply line 4 at the upper end of the storage tank communicating with the vapor region 2*b*. A gas motor $M_1$ is provided in the supply line 4 for using the pressure difference of the vaporized gas supplied to the consumer to operate the circulation pump $P_1$, described below.

The apparatus illustrated in FIG. 1 includes a system, generally designated 10, for adding directly to the liquified gas in the storage tank 2 only sufficient heat from a source of external heat to cause the heated liquified gas to remain mostly in the liquified state but to enable the internal heat of the gas within the storage tank, together with the influx of ambient heat, to supply the heat of vaporization for vaporizing within the storage tank the liquified gas to be supplied to the consumer via supply line 4 according to the consumer demand.

Heating system 10 includes a heat-exchanger 11, which is preferably mounted on the storage tank 2 itself, for supplying heat from a primary water heater 12, which may be heated by gas, electricity or steam. Thus, heat exchanger 11 includes a first fluid circuit defined by tubing 13 through which the fluid heated in the primary water heater 12 circulated by a pump $P_2$. Heat exchanger 11 includes a second fluid circuit, defined by tubing 14, through which liquified gas is circulated by pump $P_1$ from, and back to, the storage tank.

Tubing 14 for the liquified gas, is connected to a feed tube 15 within the storage tank 2, leading to the lower liquid region 2*a* of the storage tank. This liquified gas from the liquid region 2*a* is circulated through heat-exchanger 11 by pump $P_1$and, after being heated by the heating fluid circulated therethrough via tubing 13, is outletted from the heat exchanger via tubing 16. Tubing 16 is connected to a vapor line 17 communicating with the vapor region 2*b* of the storage tank, or returning directly to liquid region 2*a*.

The amount of heat supplied by heat exchanger 11 to the liquified gas within the storage tank 2 is controlled in accordance with the demand for vaporized gas to be supplied via the supply line 4. This control assures that sufficient heat is supplied to the liquified gas to raise its temperature only such as to enable the internal heat of the liquified gas in the storage tank, together with the influx of ambient heat, to supply the heat of vaporization according to the demand for the vaporized gas. That is, heat exchanger 11 adds sufficient heat to the liquified gas circulated through the heat exchanger, via the inlet line 14, to produce less than 50%, preferably 0–20%, vaporization in the gas which is heated and returned to the storage tank via the heat-exchange output line 16. Thus, the heated gas returned to the storage tank via line 16 may be a mixture of vapor and liquid; but since this heated gas is returned to the storage tank (i.e., the vapor region 2*b* of the storage tank), the separation of the vapor from the liquid will be effected within the storage tank itself, without the need for liquid/vapor separation devices or controls.

The heating system 10 is controlled by a microprocessor 20 according to the temperature and pressure of the gas within the storage tank 2. For this purpose, the liquid storage tank 2 includes a temperature sensor 21 and a pressure sensor 22. Preferably, both are attached to the lower end of the feed tube 15 within the storage tank such that the sensors will sense the temperature and pressure of the gas within the liquid region 2*a* of the storage tank. The sensors, however, could be placed at any other location in the storage tank. The electrical signals produced by the temperature sensor 21 and pressure sensor 22 are inputted into the microprocessor 20.

Microprocessor 20 includes a further input representing the gas demanded to be delivered via the supply line 4. Thus, the Gas Demand input, diagrammatically indicated by block 23 in FIG. 1, may be a manual selector, automatic selector, or the like, producing an input into the microprocessor 20 corresponding to the gas demand.

The outputs from microprocessor 20 illustrated in FIG. 1 include an output line 24 controlling pump P1 in the supply line 4; output lines 25 and 26 controlling the two pumps $P_2$, $P_3$ of the heat-exchanger 11; and output line 27 controlling the water heater 12.

Figure 2:
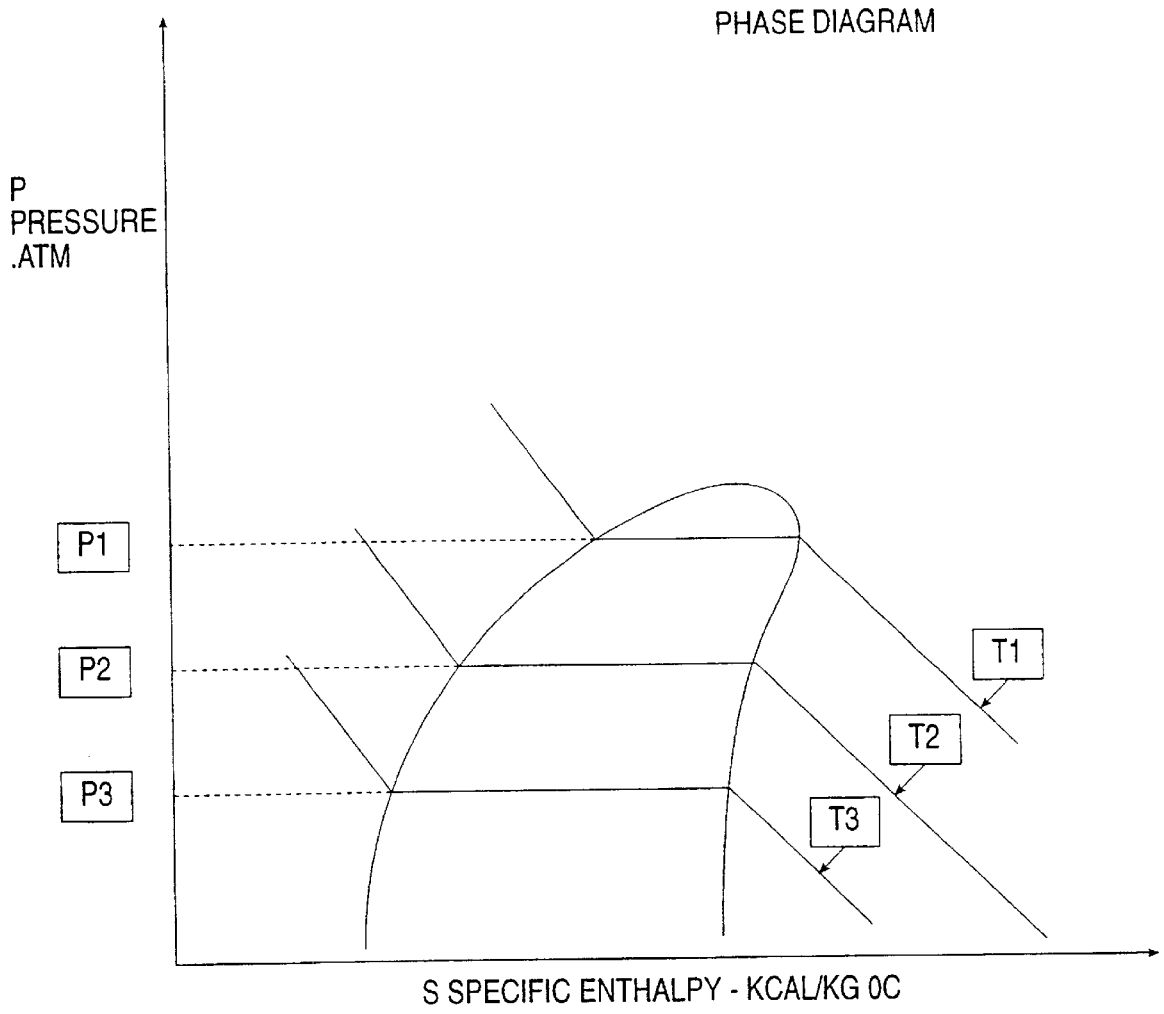
FIG. 2 is a phase diagram for the supplied liquified gas, which diagram will be helpful in understanding the operation and advantages of the present invention.

Microprocessor 20 is preferably programmed to control the supply of external heat to the liquified gas within tank 2 according to the phase diagram for the particular gas stored within the storage tank. FIG. 2 illustrates a typical phase diagram illustrating the heat of vaporization required with respect to three pressures $P_1$–$P_3$ and three temperatures $T_1$–$T_3$. Thus, as shown in the phase diagram of FIG. 2, less heat will be needed to vaporize the liquid gas at temperature $T_1$, than at temperature $T_2$ or $T_3$. Using the phase diagram for the respective gas enables both the heat to be added by the external head source, and the pollution caused by that source, to be minimized.

Figure 3:
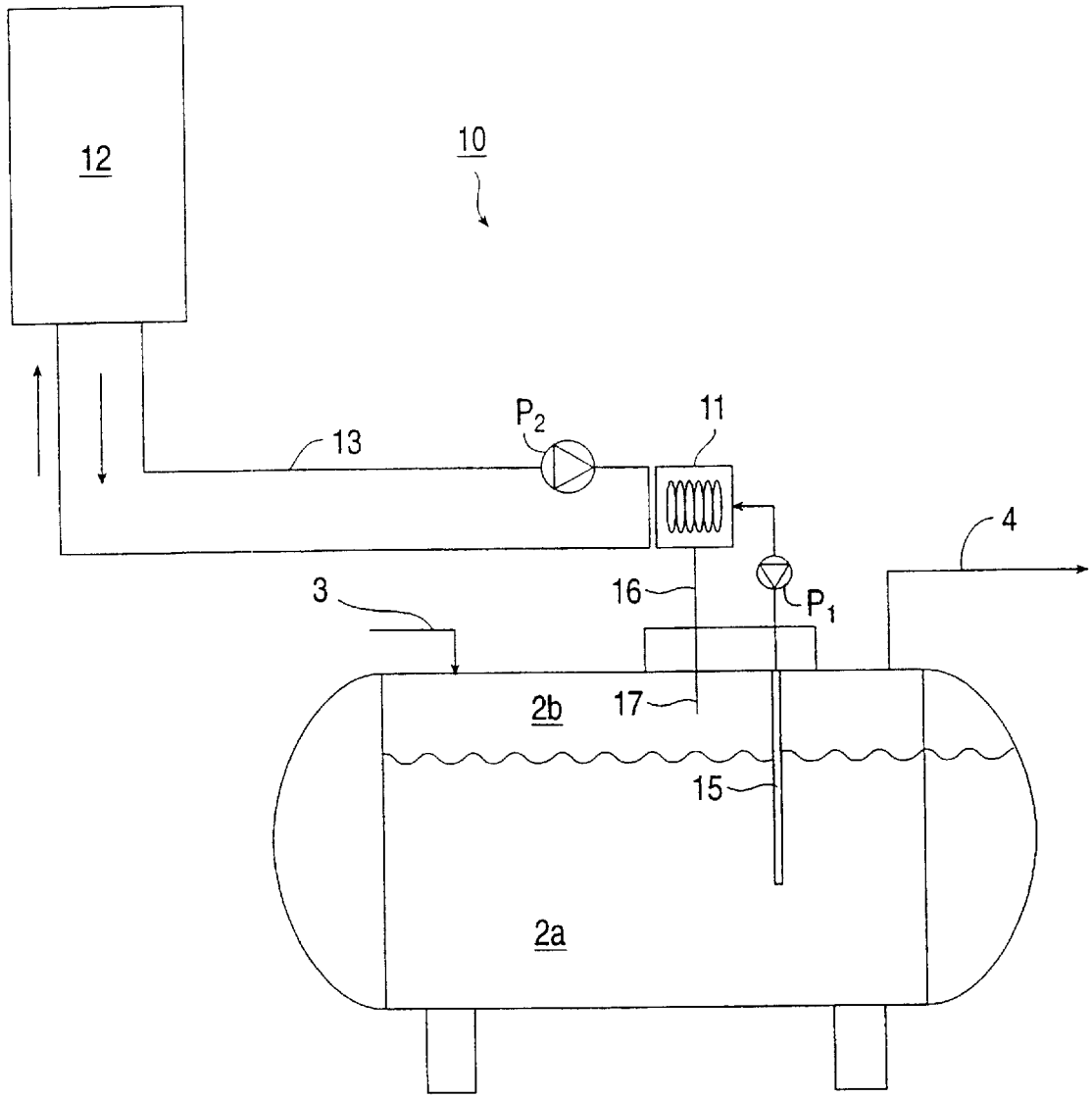
FIGS. 3 and 4 illustrate apparatus similar to that of FIG. 1, but somewhat simplified.

FIG. 3 illustrates a variation in the apparatus of FIG. 1, omitting the gas motor $M_1$ in the gas supply line 4. In such an arrangement, the circulation pump $P_1$, for circulating the liquified gas through the heat-exchanger 11, would have its own drive (such as a hydraulic, pneumatic, magnetic or electrical pump). For purposes of simplifying the drawing of FIG. 3, the controls in the apparatus of FIG. 1 are omitted but it will be appreciated that FIG. 3 would include such controls and would otherwise operate in the same manner as described above with respect to FIG. 1.

Figure 4:
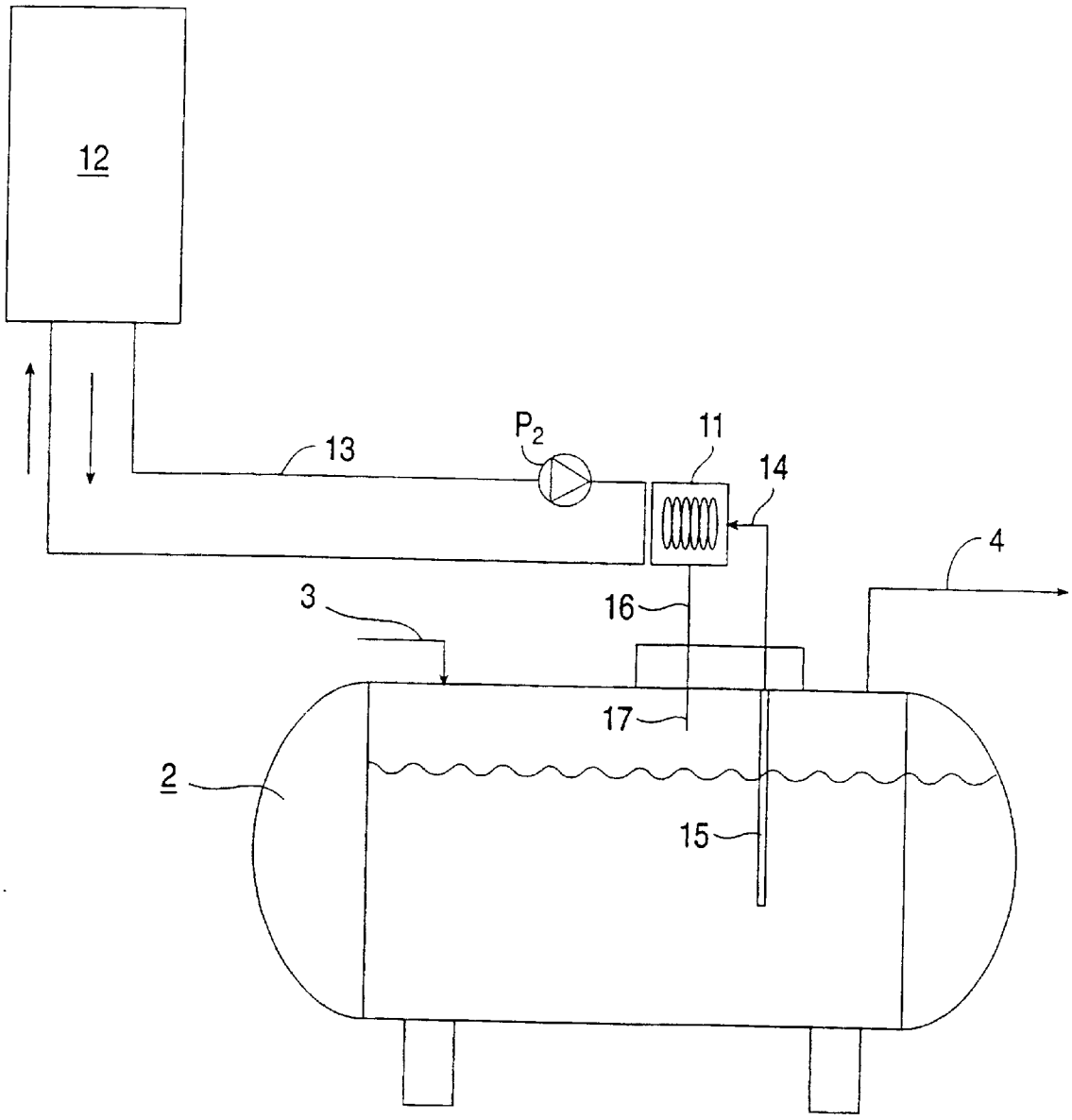

FIG. 4 illustrates a further simplification in the apparatus, in that the circulation pump $P_1$ for circulating the liquified gas through the heat exchanger 11 is omitted. In this case, the circulation of the liquified gas from the liquid region 2*a* of the storage tank through the heat exchanger 11, and back to the vapor region 2*b* of the storage tank, would be by thermal circulation. It will be appreciated that the apparatus of FIG. 3 would also include the controls and would otherwise operate in the same manner as described above with respect to FIG. 1.

Figure 5:
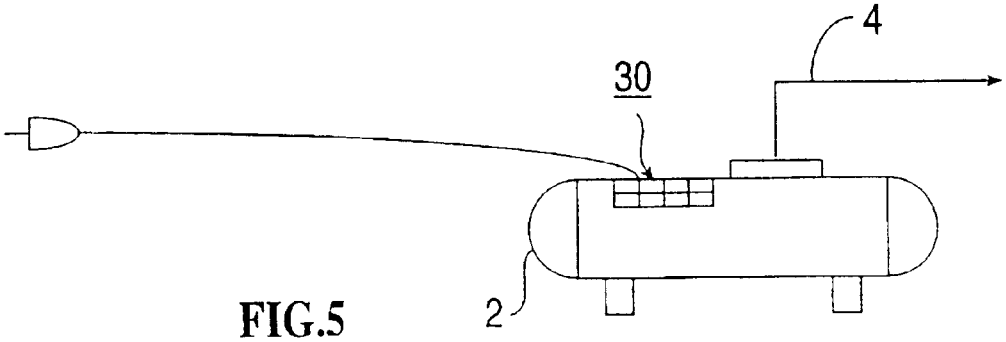
FIGS. 5–7 diagrammatically illustrate other forms of apparatus which can be used in practicing the present invention.
Figure 6:
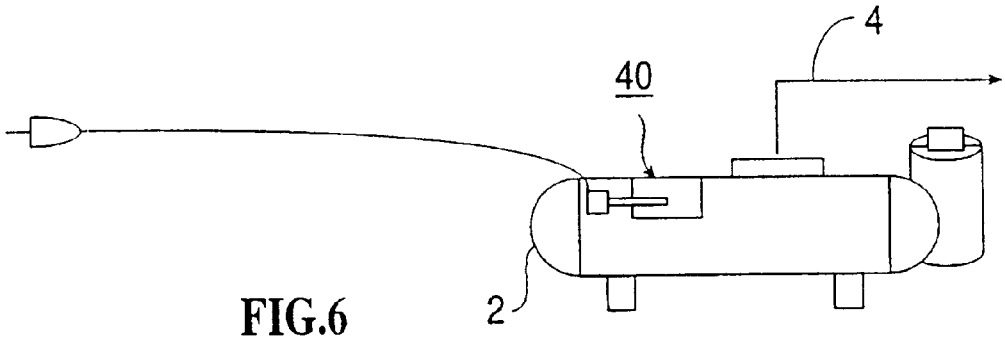
Figure 7:
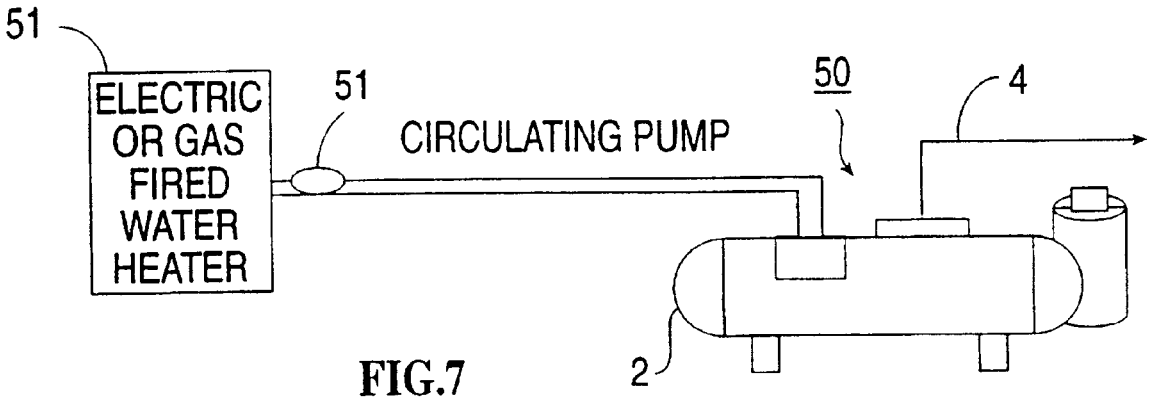

FIG. 5 illustrates a further simplified arrangement wherein the storage tank 2 is heated, to supply the needed heat for vaporizing the gas, by an electrical blanket, generally designated 30, directly applied to the external surface of the storage tank. FIG. 6 illustrates a further variation wherein an electrically heated water blanket, generally designated 40, is applied to the outer surface of the storage tank 2 for supplying the needed external heat for vaporizing the liquified gas. FIG. 7 illustrates a further variation wherein a water blanket, generally designated 50, directly applied to the external surface of the storage tank 2, and receiving heat from an electrical or gas-fired water heater 51 via a circulation pump 52, is used for supplying the external heat to vaporize the liquified gas. The apparatus illustrated in FIGS. 5, 6 and 7 is particularly useful in underground storage tanks. The gas is supplied to the consumer, in such apparatus, via supply line 4 directly from the vapor region 2*b* of the storage tank so as to avoid the need for liquid/vapor separators. Also, the control for the respective external heat source may be substantially the same, based on the phase diagram of the gas as described above with respect to FIGS. 1 and 2, to supply only sufficient heat to the liquified gas to enable the internal heat of the liquified gas within the storage tank, together with the influx of ambient heat, to supply the heat of vaporization for vaporizing, within the storage tank, the liquified gas according to the consumer demand therefor.

Figure 8A:
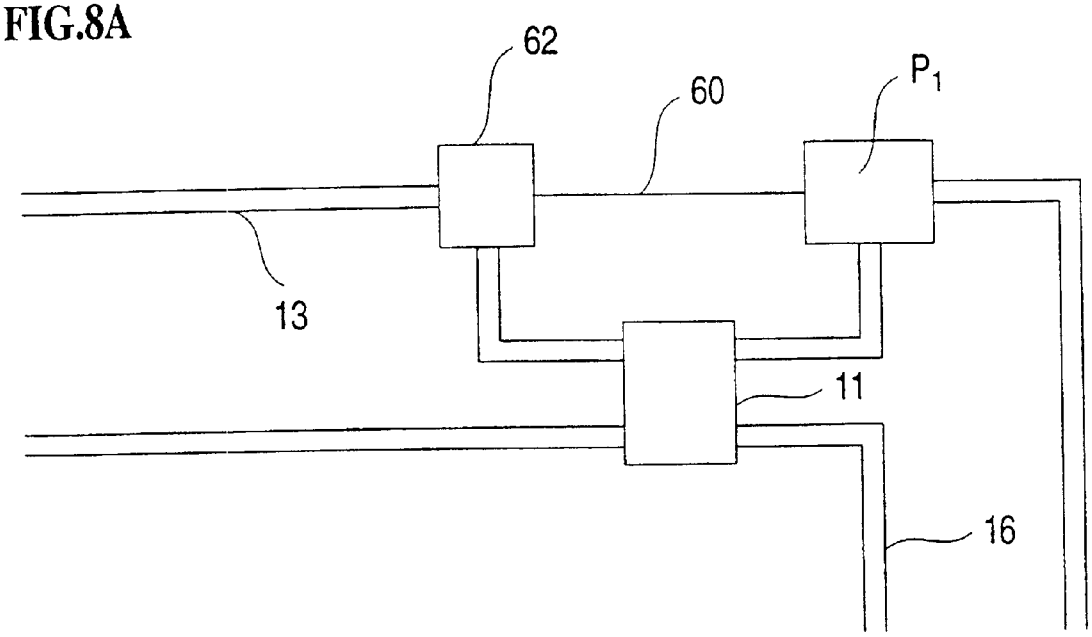
FIGS. 8A and 8B show preferred variants of a pump configuration for use in the apparatus of FIG. 3.
Figure 8B:
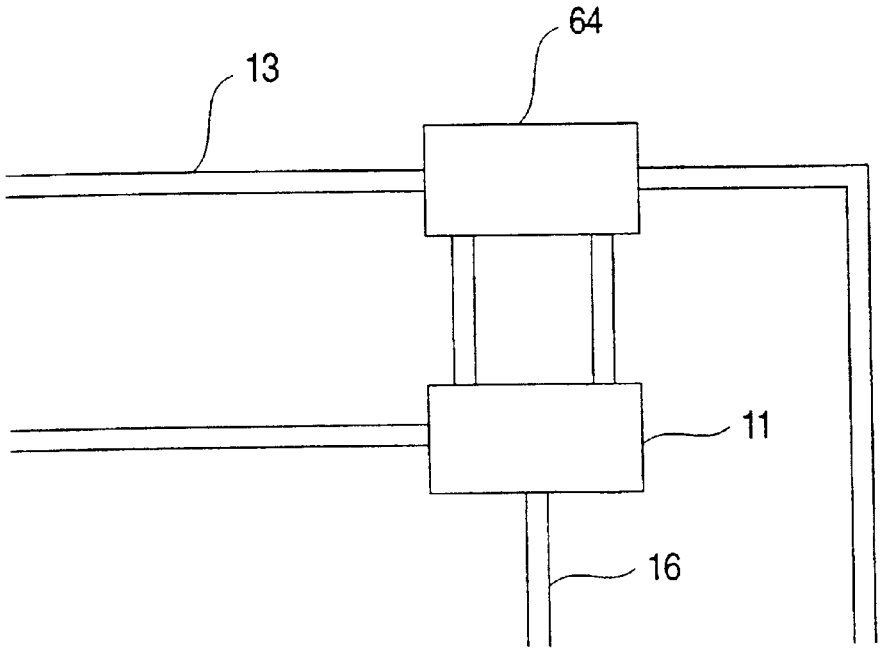

Finally, with reference to FIGS. 8A and 8B, one particularly advantageous implementation of the apparatus of the present invention employs pressure from the circulation of water in heating system 10 to drive pump $P_1$. This implementation is a specific case of actuation by a hydraulic motor as described above in the context of FIG. 3. In the implementation of FIG. 8A, pump $P_1$ is driven via a mechanical linkage 60 by a hydraulic motor 62 which recovers mechanical power from the water flow in tubing 13. This configuration may be implemented with any suitable type of pump including, but not limited to, vane-, impeller- and gear-pumps. FIG. 8B illustrates an alternative implementation through which a diaphragm pump 64 is used. This allows the liquified gas to be pumped directly by direct use of power from the water flow without a separate mechanical linkage. In both cases, this configuration provides advantages of safety and ease of installation by allowing all electrical components to be located remotely from storage tank 2. Furthermore, in a further option, it allows remote control of the rate of flow generated by pump $P_1$ by varying the flow rate of the water. Thus, the heat exchange relation is controlled at least in part by varying a flow rate of the heat exchange liquid, and hence of the liquified gas through the heat exchanger. This option has further safety advantages for applications to flammable gases since all electrical actuators can be deployed in positions well removed from the storage tank itself.

As mentioned above, it is a preferred feature of most implementations of the present invention that, in contrast to the evaporators of the prior art, most if not all of the heated liquified gas does not change phase during the supply of heat. Particularly in the case of an external heat exchanger, this renders operation of the heat exchanger and pump much more efficient.

In order to maintain the liquid phase of the heated liquified gas, the flow rates and the temperature of the heat exchange liquid should be appropriately chosen. As an additional preferred feature, the heated liquified gas is returned to the storage tank along a restricted flow path configured to maintain a given pressure within the heat exchanger so as to limit vaporization of the liquified gas within the heat exchanger. In a basic implementation, the restricted flow path is implemented as a mechanical constriction of a conduit. Alternative implementations employ a pressure-release valve designed to maintain a predefined back-pressure. This ensures efficient operation of the pump and heat exchanger while offering rates of heat exchange for a given volume flow which might otherwise cause significant local vaporization. On return to the main body of liquified gas within the storage tank, the heat is rapidly dispersed, thereby avoiding excessive vaporization as described above.

Even where a restricted flow path is used, it should be noted that the present invention achieves high efficiency and minimum heat losses by working exclusively with much lower temperatures than the vaporizers of the prior art. Thus, the heating liquid (typically water) for most applications is preferably kept at no more than about 35° C., while the liquified gas is for most applications raised to no more than about 5° C. above the ambient temperature. Furthermore, in cases where the ambient temperature is sufficient to provide the required initial rate of supply, the apparatus of the present invention functions primarily, if not exclusively, to stabilize the temperature against dropping below a predefined base temperature required for sufficient gas supply rates. Thus, the apparatus provides the part of the heat of evaporation for a given rate of gas supply which exceeds the rate of heat absorption from the surroundings. In simple applications, this can be achieved merely by thermostatic control of the system. In more sophisticated implementations, microcomputer control is used to provide increased performance and/or efficiency such as by preempting drops in temperature before they occur and by maintaining the liquified gas temperature at a level appropriate for the present or predicted flow supply requirements.

While the invention has been described with respect to several preferred embodiments, it will be appreciated that these are set forth merely for purposes of illustrating the invention, and that many other variations, may be made. For example, the storage tank may be above-ground and below-ground storage cylinders, the pressure and temperature sensors may be located at the inlet or outlet of the storage tank, and the heating blankets in FIGS. 5–7 may be located anywhere on the tank. Many other variations, modifications and applications of the invention will be apparent.

What is claimed is:

1. An apparatus comprising:

a storage tank storing the gas as a liquefied gas in a lower liquid region thereof and having a vapor region thereover;

a heating system including an external source of heat and a circulation system for circulating a heat exchange liquid having a pressure, said circulation system being configured such that said heat exchange liquid is heated by said external source of heat and is brought into heat-exchange relation with at least a portion of said liquefied gas for supplying heat thereto; and a control system associated with said heating system and configured to control a rate of heat supply to said liquefied gas, wherein said circulation system includes:

a liquified gas flow path having an inlet in fluid communication with said lower liquid region within said storage tank;

a heat exchanger, external to said storage tank, within which said heat exchange liquid and said liquefied gas come into heat-exchange relation, and a pump deployed for passing the liquefied gas through said heat exchanger, said pump being driven by said pressure of said heat exchange liquid.

2. The apparatus of claim 1, wherein said heating system is designed and configured such that any electrical components are disposed remotely from said storage tank.

3. The apparatus of claim 2, wherein said control system is designed and configured such that said heating system vaporizes at least some of said portion of said liquefied gas.

4. The apparatus of claim 3, wherein said pump is a diaphragm-type pump.

5. The apparatus of claim 3, further comprising:

a hydraulic motor, driven by said pressure of said heat exchange liquid, for driving said pump, and a mechanical linkage for operatively connecting said hydraulic motor to said pump.

6. The apparatus of claim 5, wherein said pump is selected from the group consisting of a vane pump, an impeller pump, and a gear pump.

7. The apparatus of claim 3, further comprising:

a supply line communicating with said vapor region of said storage tank for supplying a vaporized gas to a consumer according to a consumer demand.

8. The apparatus of claim 7, further comprising:

a hydraulic motor, driven by said pressure of said heat exchange liquid, for driving said pump, and a mechanical linkage for operatively connecting said hydraulic motor to said pump.

9. The apparatus of claim 8, wherein said pump is selected from the group consisting of a vane pump, an impeller pump, and a gear pump.

10. A method of supplying vaporized gas from a storage tank storing the gas as a liquefied gas in a lower liquid region and having a vapor region thereover, the method comprising:

employing an external source of heat to heat a heat exchange liquid;

circulating at least a portion of the liquefied gas through a heat exchanger to produce heated liquefied gas, said heat exchanger being fluidly connected to the storage tank;

bringing said heat exchange liquid into heat exchange relation with said at least a portion of the liquefied gas, so as to transfer heat from said heat exchange liquid to said at least a portion of the liquefied gas in said heat exchanger, and supplying vaporized gas to a consumer, according to consumer demand, directly from the vapor region of the storage tank, wherein said heat exchange relation is controlled such that said at least a portion of said heated liquefied gas being discharged from said heat exchanger remains mostly in a liquefied state.

11. The method of claim 1, wherein said heat exchanger is external to the storage tank.

12. The method of claim 1, wherein said circulating of the liquefied gas is performed by means of a pump, said pump being driven by pressure of said heat exchange liquid.

13. The method of claim 1, wherein said heat exchange relation is controlled, at least in part, by varying a flow rate of said heat exchange liquid.

14. The method of claim 13, wherein said heat exchange relation is controlled, at least in part, by varying a flow rate of said heat exchange liquid, and hence, a flow rate of the liquefied gas, through said heat exchanger.

15. The method of claim 11, wherein said circulating is achieved by means of a pump, and wherein said heated liquefied gas discharged from said heat exchanger is returned to the storage tank along a restricted flow path configured to maintain a given pressure within said heat exchanger, so as to limit vaporization of the liquefied gas within said heat exchanger.

16. The method of claim 11, wherein said heat exchanger is mounted on the storage tank.

17. The method of claim 1, wherein said heat exchange relation is controlled such that said heat exchange liquid heating the liquefied gas being circulated through said heat exchanger vaporizes less than 50% of said heated liquefied gas that is returned to the storage tank.

18. The method of claim 1, wherein said heat exchange relation is controlled such that said heat exchange liquid heating the liquefied gas being circulated through said heat exchanger vaporizes less than 20% of said heated liquefied gas that is returned to the storage tank.

19. The method of claim 1, wherein heat supplied by said external source of heat is controlled according to temperature and pressure of the liquefied gas within the storage tank and a liquid/vapor phase diagram of the gas.

20. An apparatus for supplying vaporized gas from liquefied gas on consumer demand, the apparatus comprising:

(a) a storage tank storing the gas in liquefied form in a lower liquid region thereof and having a vapor region thereover;

(b) a heating system including:

(i) an external source of heat for heating a heat exchange liquid;

(ii) a heat exchanger fluidly communicating with said storage tank, and (iii) a circulation system for circulating said heat exchange liquid through said heat exchanger and for circulating a portion of the liquefied gas through said heat exchanger, such that said heat exchange liquid and said portion of the liquefied gas are brought into heat-exchange relation in said heat exchanger;

(c) a control system associated with said heating system, and (d) a supply line communicating with said vapor region of the storage tank for supplying vaporized gas to a consumer, wherein said heating system and said control system are configured to control heat supply to said liquefied gas such that said portion of the liquefied gas being discharged from said heat exchanger remains mostly in a liquefied state.

21. The apparatus of claim 20, wherein said heating system and said control system are further configured to provide heat from said heat exchanger so as to provide vapor to said consumer via said supply line, according to the consumer demand therefor.

22. The apparatus of claim 20, wherein said circulation system includes a liquefied gas flow path having an inlet and an outlet, both in fluid communication with the liquefied gas within said storage tank.

23. The apparatus according to claim 21, wherein said circulation system further includes a pump deployed for passing said at least a portion of the liquefied gas through said heat exchanger, said pump being driven by pressure of said heat exchange liquid.

24. The apparatus according to claim 23, wherein said control system controls said rate of heat supply, at least in part, by varying a flow rate of said heat exchange liquid, and hence of said at least a portion of the liquefied gas, through said heat exchanger.

25. The apparatus according to claim 21, wherein said circulation system further includes a pump deployed for passing said at least a portion of the liquefied gas through said heat exchanger, and wherein said liquefied gas flow path includes a flow restriction deployed so as to maintain a given pressure within said heat exchanger, thereby limiting vaporization of the liquefied gas within the heat exchanger.

26. The apparatus according to claim 21, wherein said control system includes:

a temperature sensor deployed for obtaining a sensed temperature of the liquefied gas in said storage tank;

a pressure sensor for obtaining a sensed pressure of the liquefied gas in said storage tank, and a controller for controlling said heat supply from said source of external heat to the liquefied gas in the storage tank according to said sensed temperature and said sensed pressure of the liquefied gas.

27. The apparatus according to claim 26, wherein said controller is further configured for controlling said heat supply from said source of external heat to the liquefied gas in the storage tank according to a liquid/vapor phase diagram of the gas.

* * * * *